US005121783A

United States Patent [19]

Nilsson

[11] Patent Number: 5,121,783

[45] Date of Patent: Jun. 16, 1992

[54] WINDOW COVERING APPARATUS

[76] Inventor: Roland Nilsson, Adolf Fredriksgatan,, 6E 21774 Malmo, Sweden

[21] Appl. No.: 496,699

[22] Filed: Mar. 21, 1990

[51] Int. Cl.[5] ..... E06B 3/32

[52] U.S. Cl. ..... 160/89; 160/115; 160/84.1; 160/168.1

[58] Field of Search ..... 160/89, 115, 84.1, 166.1, 160/168.1, 178.1, 176.1, 87

[56] References Cited

U.S. PATENT DOCUMENTS

| | | | |
|---|---|---|---|
| 2,646,114 | 7/1953 | Kearny | 160/89 |
| 4,621,672 | 11/1986 | Hsu | 160/115 |
| 4,733,711 | 3/1988 | Schon | 160/84.1 |
| 4,799,524 | 1/1989 | Guermonprez | 160/84.1 |
| 4,813,468 | 3/1989 | Fraser | 160/84.1 |
| 4,940,070 | 7/1990 | Warden | 160/115 X |

*Primary Examiner*—David M. Purol

[57] ABSTRACT

A window covering apparatus includes a venetian blind having a head rail, a pluality of slats, and a bottom rail. Flexible slat support cords or ladder tapes are attached from the head rail to support a plurality of slats and the bottom rail from the head rail. The venetian blind has a lift cord and a lift cord lock for raising and lowering the blinds and a tilt control for adjusting the tilt to the blind slats. A pleated shade is attached to the bottom rail of the venetian blind and has a foldable pleated shade portion having a bottom rail attached to the bottom thereof. A lift cord is attached through a lift cord lock located in the venetian blind head rail and extends through the venetian blinds and venetian blind bottom rail and through the folded pleats of the pleated shade and attaches to the pleated shade bottom rail so that the pleated shade can be raised and lowered independently of the venetian blind with a second lift cord and lift cord lock in the venetian blind head rail.

8 Claims, 1 Drawing Sheet

WINDOW COVERING APPARATUS

BACKGROUND OF THE INVENTION

The present invention relates to window coverings and especially to a window covering adapted to be used as a venetian blind or as a folding pleated shade or as a combination of the two.

Venetian blinds have been used for several hundred years and have included a wide variety of improvements over the years. Venetian blinds today typically have a head rail for attaching the blinds to a window or door opening and have a plurality of slats held with a slat supporting cord or ladder tape attached at one end to the head rail. A bottom rail is attached at the other end of the slat supporting tape. Venetian blinds typically have lift cords which can lift the venetian blinds from the bottom rail up and a cord lock is mounted in the head rail for locking the raised blinds in any desired position. Venetian blinds also typically have tilt controls which can tilt the slat support tape to tilt the blinds to any angle desired for blocking the entrance of sunlight or for blocking visibility into or out of a window opening.

Window shades on the other hand have typically been mounted on rolls and are frequently found with springloaded rollers with catch mechanisms so that they can be rolled down to cover a portion of a window opening. However, there have been a great many variations and improvements to fabric window shades and these might include anything from roll down bamboo shades to a foldable pleated fabric shade in which each fold is similar to a venetian blind slat except attached along the elongated edge such that they fold one onto the other. This does have the advantage of allowing the pleated shade to be operated similar to a venetian blind in terms of raising or lowering the shade but without the use of a tilt mechanism.

The present invention is directed towards a window covering which has a full venetian blind and pleated shade combined such that the pleated shade is attached to the bottom rail of the venetian blind and can be independently operated from a lift cord attached to the head rail of the venetian blind. When the pleated shade is pulled all the way up against the bottom rail of the venetian blind, it appears to be an additional raised blind portion. However, the venetian blind can be raised all the way up separately and the pleated shade dropped so that the window covering appears to be a pleated foldable shade rather than a venetian blind. In addition, the venetian blind and the pleated shade can each be raised or lowered to any degree desired such that one using the present invention can have a venetian blind or a pleated shade or a combination and variation of the two simultaneously for covering a window opening.

Typical prior art U.S. Pats. may be seen in the Hsu Pat. No. 4,621,672 and in the G.A. Lombard Pat. No. 3,111,164 and in the C.B. White Pat. No. 2,706,522 which patents are for window blinds having a plurality of slats which can be set for different tilts. The U.S. Pat. Nos. to S. Pinto No. 2,914,122 is for a combination vinyl plastic venetian blind and screen and No. 2,994,370 is a combination venetian blind and screen. U.S. Pat. No. 3,946,789 to Ronkholz-Tolle, nee Tolle is for a slatted curtain.

SUMMARY OF THE INVENTION

The present invention relates to a window covering which has a venetian blind having a head rail for attaching at the top of the window opening or the like and has a plurality of slats and a bottom rail held together with a flexible slat support cord or ladder tape connected to the head rail and supporting each of the plurality of slats individually and attached to the bottom rail. A flexible lift cord extends from the head rail for raising and lowering the plurality of slats and a first lift cord lock has a flexible lift cord extending therethrough for locking a plurality of slats in a raised or lowered position when the bottom rail is raised or lowered. A pleated shade has a foldable pleated shade portion having a top and bottom portion and supported at the top portion on the venetian blind bottom rail. The pleated shade bottom rail has the bottom portion of the foldable pleated shade portion attached thereto. A second flexible lift cord is attached from the venetian blind head rail through the venetian blind slats and through each of the folds of the foldable pleated shade portion to the pleated shade bottom rail. A pleated shade lift cord lock is located in the venetian blind head rail and has a flexible lift cord coupled therethrough so that the second flexible lift cord extends through the venetian blinds a plurality of slats and through each foldable pleat of the pleated shade such that the pleated shade can be raised or lowered on the venetian blind bottom rail by the lift cord from the venetian blind head rail independently of the venetian blind. The pleated folds of the foldable pleated shade have apertures therethrough for the passage of the lift cord as does each of the venetian blind slats. In addition, the bottom rail of the venetian blind has an aperture passing therethrough for passing the foldable pleated shade lift cord. The venetian blinds have tilt control in each of the lift cord locks for the venetian blind and for the folded pleated shade and are attached at opposite ends of the venetian blind head rail. The pleated shade has a plurality of elongated folds, each fold or slat having one elongated edge attached to the next adjacent elongated fold to form a foldable pleated shade which may be of a translucent fabric material.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
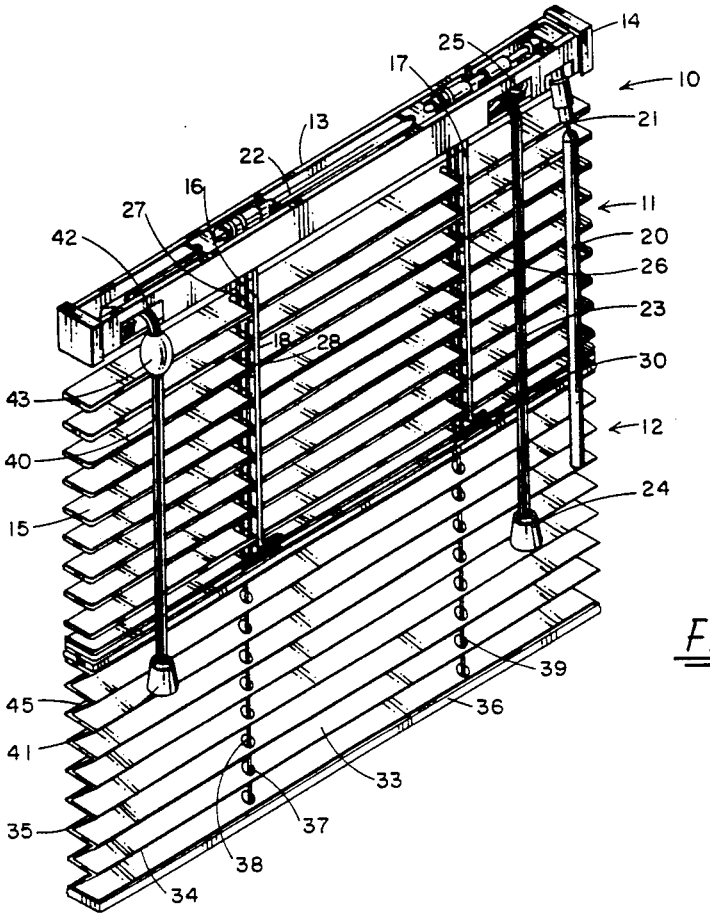
FIG. 1 is a perspective view of a window covering in accordance with the present invention.
Figure 2:
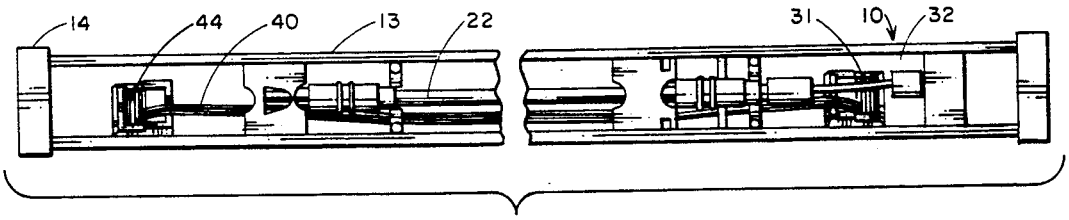
FIG. 2 is a top plan view of the window covering of FIG. 1.
Figure 3:
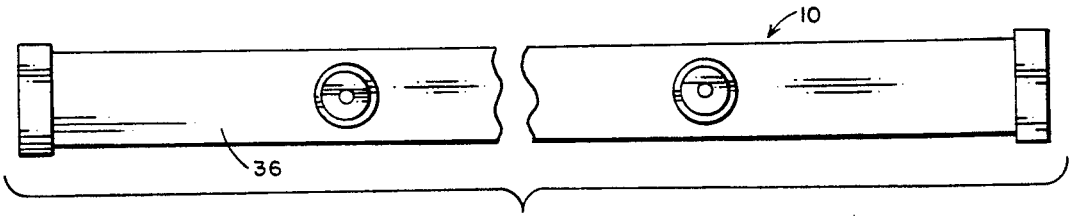
FIG. 3 a bottom plan view of the window covering of FIG. 1.

Referring to the drawings, a window covering 10 has a venetian blind portion 11 and a pleated shade portion 12. The window covering 10 has a head rail 13 for use in supporting the window covering 10 at the top of a window or other opening in a building. The head rail has end caps 14 on each end thereof. A plurality of venetian blind slats 15 are supported by two sets of flexible slat supports or ladder tapes 16 and 17 which may be parallel cords or tapespassing on either side of the slats 15 and having a plurality of transverse slat support cords or tape 18. The venetian blind has a tilt control arm 20 connected to a universal connection 21 to a rotating shaft 22 which rotates one side of the flexible ladder tape 16 and 17 relative to the other to tilt the blind slats 15 in one direction or the other as desired. The venetian blind lift cord 23 has a handle 24 on the end thereof and passes through an opening 25 with a cord lock in the head rail 13. The venetian blind lift cord 23 lifts a pair of venetian blind control cords 26 and 27 passing through apertures 28 in each of the slats 15 and being attached to a venetian blind bottom rail 30. Thus pulling on the cord 23 pulls the cords 26 and 27 to lift the rail 30 lifting each slat 15 thereagainst as the venetian blind is raised or to spread the venetian slats 15 apart as the bottom rail 30 is lowered. A lift cord lock 31 is mounted in the head rail 13, channel portion 32 and may have a plurality of teeth on two rollers having the cord 23 passing therethrough with one gear adapted to slide into the other to provide a friction lock for the cord 23 and to hold the blind slats 15 and bottom rail 30 in any desired position.

The pleated shade portion 12 has a plurality of foldable pleated portions 33 each connected along one elongated edge to the next adjacent fold at a fold line 34 and each folded pleat 33 connected at the opposite end thereof at 35 to the next fold in the opposite direction so that an accordian-like pleated fabric shade is produced which can be raised and lowered similar to a venetian blind except formed as a solid fabric shade. A bottom rail 36 is attached to the bottom of the pleated shade portion 33 to provide weight for raising and lowering the folded pleated folds 33. Each fold 33 has a pair of apertures 37 therethrough and the venetian blind bottom rail 30 has an aperture therethrough for the passage of lift cords 38 and 39 through each of the pleats 33 and attaching to a pleated shade bottom rail 36. The cords 37 and 38 also pass through the openings 28 through each of the venetian blind slats 15 and into the head rail 13. A pleated blind control cord 40 has a handle 41 attached thereto and passes through an opening 42 in the head rail 13. A slidable bead 43 may be on the cord 40 to identify the pleated shade 12 lift control cord. The shade lift control cord 40 passes through a second lift control support lock 44 also having a geared roller adjacent a second roller with the cord 38 and 39 passing therethrough for holding the cord 40 in the desired position. The cord 40 is actually two small cords 38 and 39 which are divided so that one becomes cord 38 and one becomes cord 39. Thus by pulling on the cord 40, the bottom rail 36 is lifted by pulling the cords 38 and 39 through the pleated folds 33 and through the venetian blind slats 15 and can be locked in any raised or lowered position below the venetian blind bottom rail as desired by the cord lock 44. The topmost folded pleat 45 is attached to the venetian blind bottom rail 30. Similarly, the venetian blind can be raised or lowered by pulling the lift cord 23 and the tilt of the blinds can be controlled by rotating the tilt control arm 21. Normally when the venetian blind portion 11 is being used, the bottom rail 30 is pulled by the pull cord 40 to pull the pleated shade portion 12 entirely against the bottom rail 30 so that it looks like the bottom of the venetian blind portion. The venetian blind portion is left open and can have the tilt control to work as a normal venetian blind.

Alternatively, the cord 23 can also be pulled to raise the venetian blind slats 15 and bottom rail 30 all the way into position adjacent head rail 13 so that both the pleated shade portion 12 and the venetian blind portion 11 pulled all the way up, the windows look uncovered. The venetian blind portion 11 can be left pulled all the way up with a lift cord 23 while the lift cord 40 can be allowed to let the pleated shade portion 12 extend its full length but cover the full window opening as a shade without tilt control. The shade portion 33 might be made of a translucent fabric material so as to allow light to come through the window opening but block all visibility from the outside in.

It should be clear at this point that a window covering has the added flexibility of a shade which allows light to come in but blocks all visibility or a venetian blind which allows the tilting of the venetian blind slats to control the entrance of light and visibility or a combination of the two which allows the control of the light on part of the widow such as the top portion while having a shade over the bottom portion to prevent visibility. It also allows the window covering to be changed as desired when redecorating or for change of mood. Accordingly, the present invention is not to be construed as limited to the forms shown which are to be considered illustrative rather than restrictive.

I claim:

1. A window covering comprising:

a venetian blind having:

a head rail;

a plurality of slats;

a bottom rail;

flexible slat supports attached to said head rail and supporting each of said plurality of slats thereto and said flexible slat supports being attached to said bottom rail;

a flexible lift cord extending from said head rail for raising and lowering said plurality of slats; and a first lift cord lock having said flexible lift cord extended therethrough for locking said venetian blind bottom rail and plurality of slats in a raised or lowered position; and a pleated shade having:

a foldable pleated shade portion having top and bottom portions;

a pleated shade bottom rail;

a second flexible lift cord;

a pleated shade lift cord lock located in said venetian blind head rail and having said flexible lift cord coupled therethrough, said second flexible lift cord extending through said venetian blind plurality of slats and through each foldable pleat of said shade portion and being attached to said pleated shade bottom rail, whereby said pleated shade can be raised and lowered on said venetian blind bottom rail by said second lift cord independently of said venetian blind.

2. A window covering in accordance with claim 1 in which each pleated fold has an aperture therethrough.

3. A window covering in accordance with claim 2 in which each venetian blind slat has a plurality of apertures therethrough.

4. A window covering in accordance with claim 3 in which said venetian blind bottom rail has an opening therethrough and said second lift cord passes through said bottom rail opening.

5. A window covering in accordance with claim 4 in which said venetian blind has a slat tilt control.

6. A window covering in accordance with claim 5 in which said venetian blind lift cord lock and said pleated screen lift cord lock are positioned on opposite ends of said head rail.

7. A window covering in accordance with claim 6 in which said pleated shade has a plurality of connected folds.

8. A window covering in accordance with claim 7 in which pleated shade is translucent folded fabric material.

* * * * *